US008464646B1

(12) United States Patent
Schiller

(10) Patent No.: US 8,464,646 B1
(45) Date of Patent: Jun. 18, 2013

(54) TABLE UMBRELLA RAIN GUARD ASSEMBLY

(76) Inventor: Reuben W. Schiller, Temple, TX (US)

( * ) Notice: Subject to any disclaimer, the term of this patent is extended or adjusted under 35 U.S.C. 154(b) by 0 days.

(21) Appl. No.: 13/489,548

(22) Filed: Jun. 6, 2012

(51) Int. Cl.
*A47B 37/00* (2006.01)

(52) U.S. Cl.
USPC ..... 108/50.12; 135/16

(58) Field of Classification Search
USPC ..... 108/50.12; 135/16, 20.1, 20.3, 96, 135/98
See application file for complete search history.

(56) References Cited

U.S. PATENT DOCUMENTS

| | | | | |
|---|---|---|---|---|
| 3,215,095 | A * | 11/1965 | Keppeler | 108/50.12 |
| 3,782,435 | A | 1/1974 | Sherman | |
| 4,353,569 | A | 10/1982 | Molina | |
| 5,050,654 | A | 9/1991 | Howell et al. | |
| 5,934,634 | A * | 8/1999 | Lindblom | 248/230.1 |
| 6,017,188 | A * | 1/2000 | Benton | 416/5 |
| 6,082,269 | A * | 7/2000 | Padberg | 108/44 |
| 6,109,279 | A | 8/2000 | Kloss et al. | |
| 6,178,979 | B1 | 1/2001 | Galloway | |
| 6,607,002 | B2 * | 8/2003 | Reese | 135/88.08 |
| D643,912 | S | 8/2011 | Bowman et al. | |
| 2006/0272555 | A1 * | 12/2006 | Carter | 108/50.12 |
| 2007/0062418 | A1 * | 3/2007 | Li | 108/50.12 |
| 2009/0165681 | A1 * | 7/2009 | Smith et al. | 108/50.12 |

* cited by examiner

*Primary Examiner* — Hanh V Tran

(57) ABSTRACT

A table umbrella rain guard assembly includes a table that has a pole aperture extending therethrough. A pole has a first end and a second end. The pole has a well extending inwardly from the second end. The first end of the pole is directed downwardly through the pole aperture. The well insertably receives an end of the umbrella shaft. A pedestal is positioned beneath the table. The pedestal insertably receives the first end of the pole. A collar is positioned around the pole so that the collar abuts the table when the pole is extended through the pole aperture. The collar prevents precipitation from passing through the pole aperture. A sleeve is positionable on the pole when the umbrella shaft is not positioned within the pole. A coupler is coupled to an end of the sleeve. A cap positioned on an end of the sleeve.

13 Claims, 4 Drawing Sheets

TABLE UMBRELLA RAIN GUARD ASSEMBLY

BACKGROUND OF THE DISCLOSURE

Field of the Disclosure

The disclosure relates to table umbrella rain guard devices and more particularly pertains to a new table umbrella rain guard device for protecting an umbrella pedestal from corrosion.

SUMMARY OF THE DISCLOSURE

An embodiment of the disclosure meets the needs presented above by generally comprising a table that has a pole aperture extending therethrough. The pole aperture may receive a shaft of an umbrella therethrough so that a canopy of the umbrella is positioned above the table. A pole has a first end and a second end. The pole has a well extending inwardly from the second end. The first end of the pole is directed downwardly through the pole aperture on the table so the second end is positioned above the table. The well insertably receives an end of the umbrella shaft so the umbrella canopy is positioned above the table. A pedestal is positioned beneath the table. The pedestal insertably receives the first end of the pole. A collar is positioned around the pole so that the collar abuts the table when the pole is extended through the pole aperture. The collar prevents precipitation from passing through the pole aperture. A sleeve is positionable on the pole when the umbrella shaft is not positioned within the pole. A coupler is coupled to an end of the sleeve so the coupler abuts the collar when the sleeve is positioned on the pole. A cap positioned on an end of the sleeve so the cap closes the sleeve.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
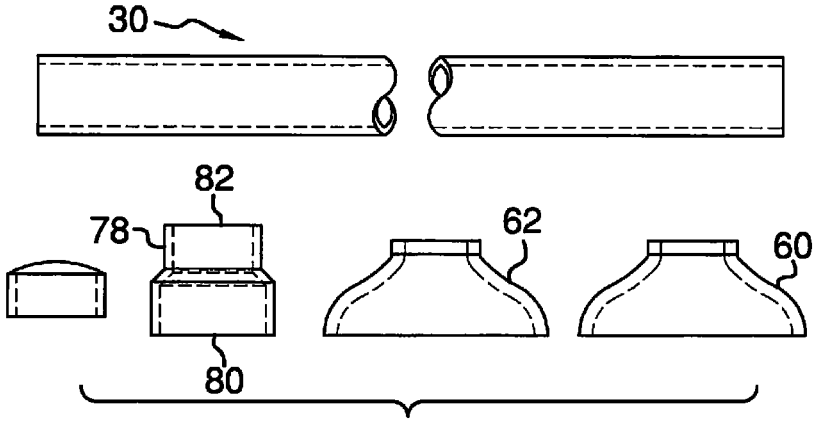
FIG. 1 is a side view of a table umbrella rain guard assembly according to an embodiment of the disclosure.
Figure 2:
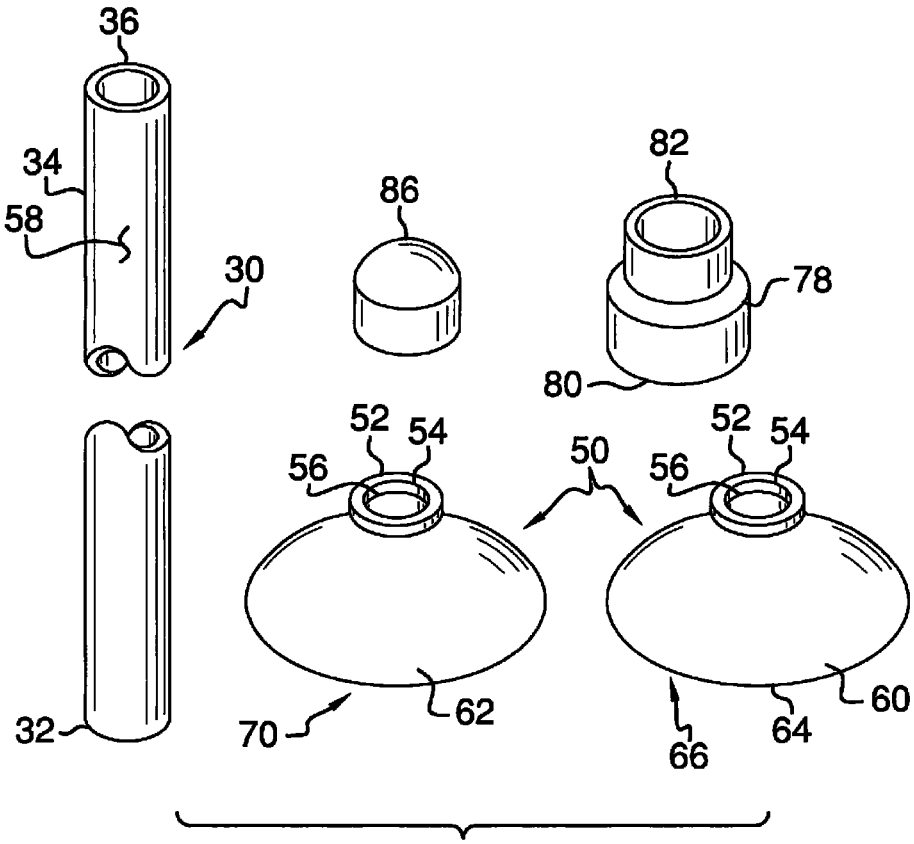
FIG. 2 is a perspective view of an embodiment of the disclosure.
Figure 3:
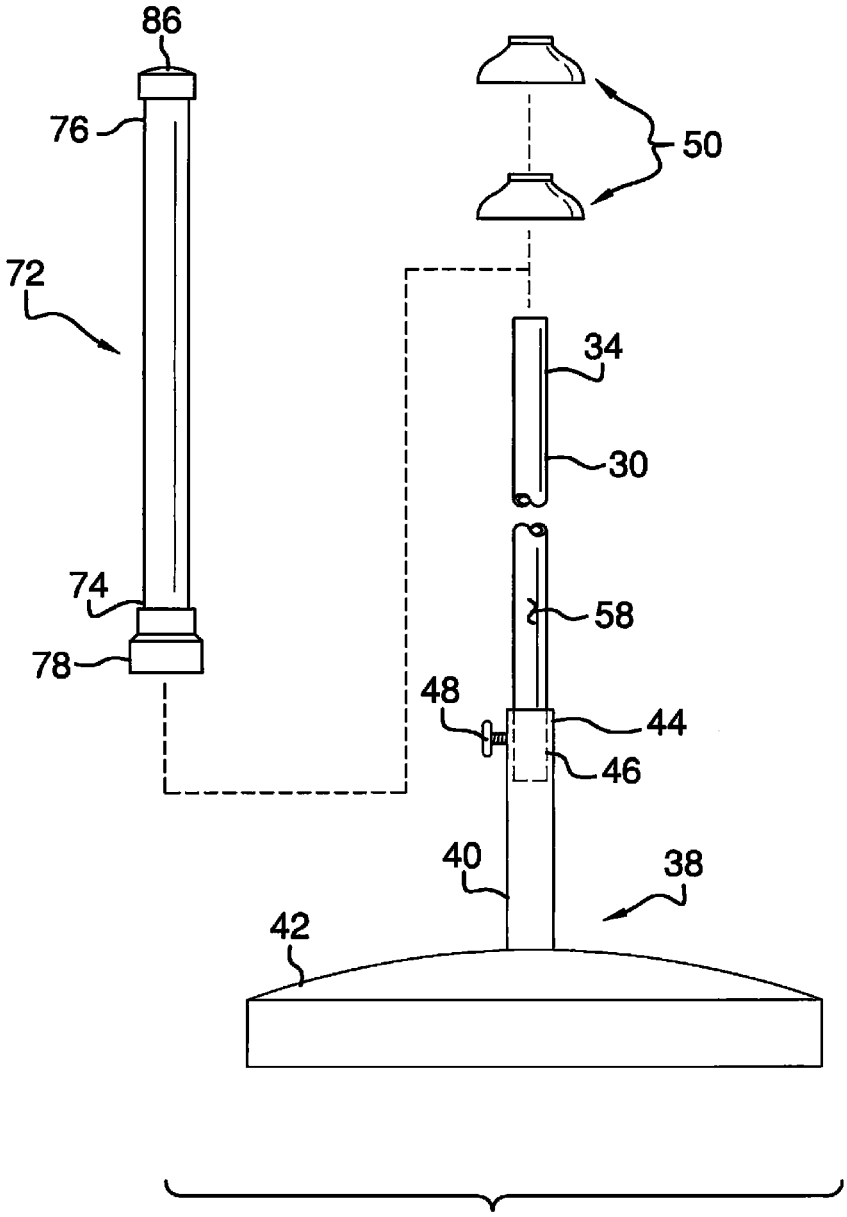
FIG. 3 is an left side view of an embodiment of the disclosure.
Figure 4:
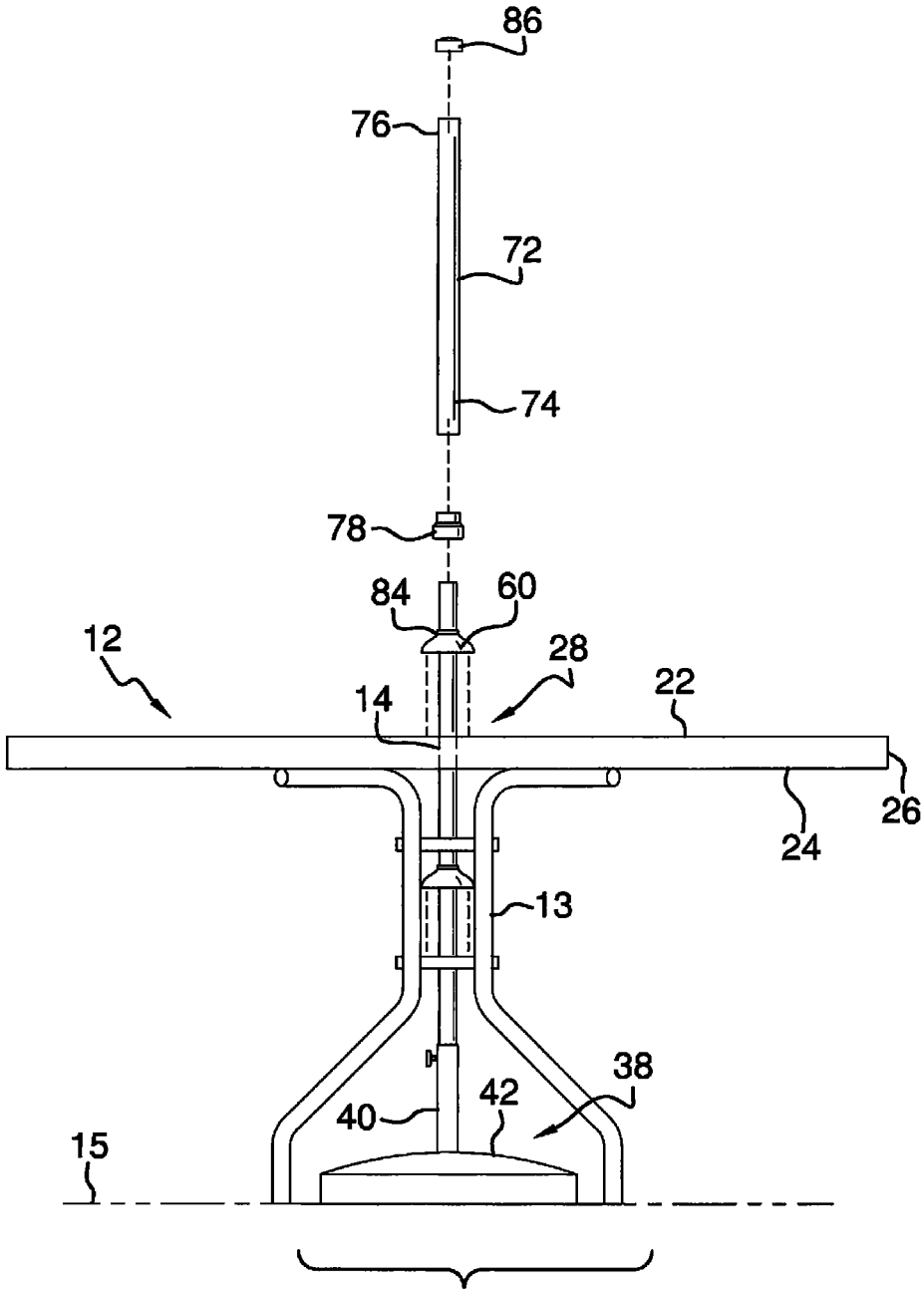
FIG. 4 is an exploded view of an embodiment of the disclosure.
Figure 5:
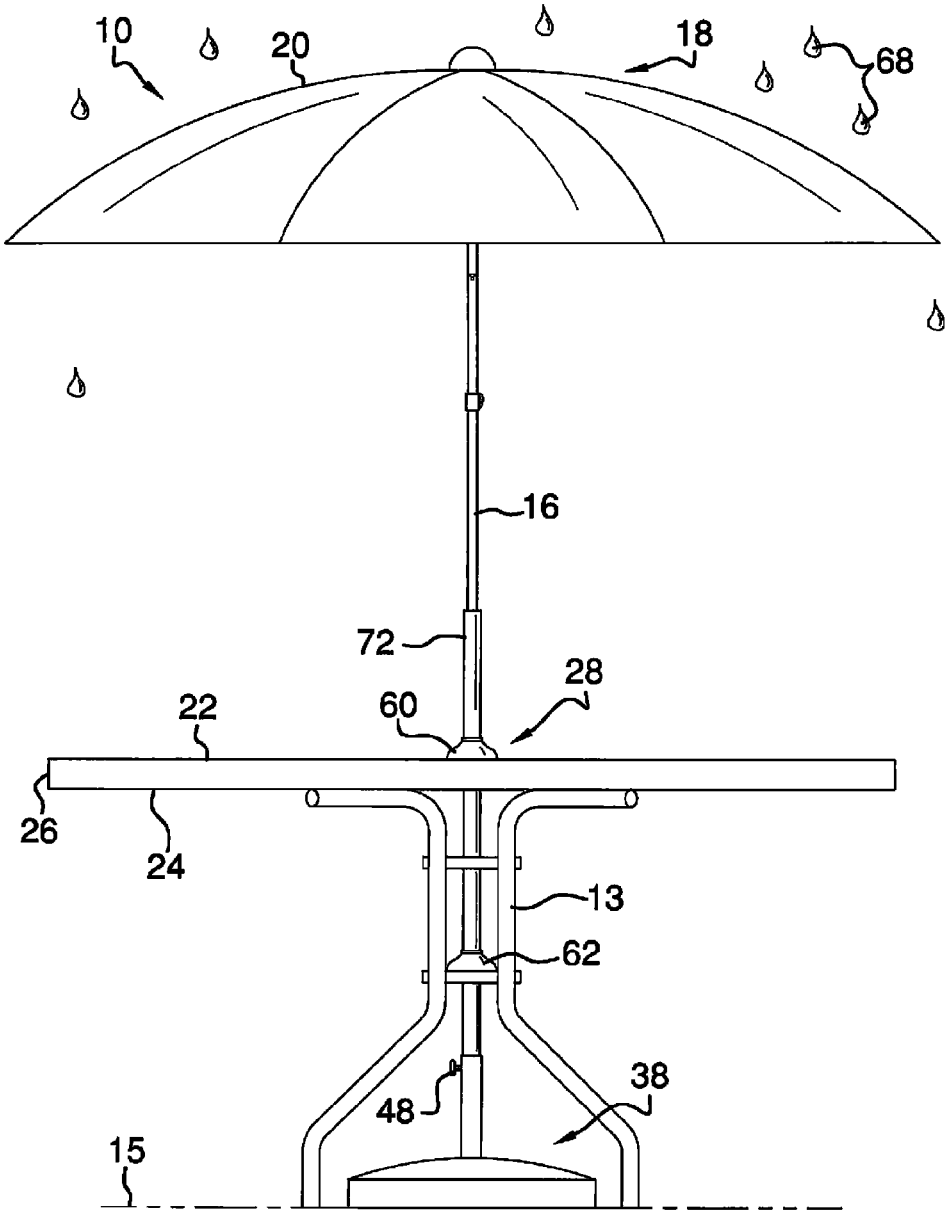
FIG. 5 is a right side view of an embodiment of the disclosure.

With reference now to the drawings, and in particular to FIGS. 1 through 5 thereof, a new table umbrella rain guard device embodying the principles and concepts of an embodiment of the disclosure and generally designated by the reference numeral 10 will be described.

As best illustrated in FIGS. 1 through 5, the table umbrella rain guard assembly 10 generally comprises a table 12 that has a pole aperture 14 extending therethrough. The pole aperture 14 may receive a shaft 16 of an umbrella 18 therethrough so that a canopy 20 of the umbrella 18 is positioned above the table 12. The table 12 has an upper surface 22, a lower surface 24 and an exterior edge 26. The pole aperture 14 is positioned at a center 28 of the table 12 so the pole aperture 14 extends through the table 12 between the upper 22 and lower 24 surfaces of the table 12.

A plurality of legs 13 are coupled to and extend downwardly from the lower surface 24 of the table 12. The legs 13 may abut a support surface 15 so the table 12 is supported above the support surface 15. The table 12 may be an outdoor patio table of any conventional design. The umbrella 18 may be of any conventional design.

A pole 30 has a first end 32 and a second end 34. The pole 30 has a well 36 extending inwardly from the second end 34. The first end 32 of the pole 30 is directed downwardly through the pole aperture 14 on the table 12 so the second end 34 is positioned above the table 12. The well 36 insertably receives an end of the umbrella shaft 16 so the umbrella canopy 20 is positioned above the table 12. The pole 30 may have a length between 0.6 meters and 0.9 meters.

A pedestal 38 is positioned beneath the table 12. The pedestal 38 has a neck section 40 coupled to and extending upwardly from a base section 42 of the pedestal 38. A top end 44 of the neck section 40 has a pole well 46 extending downwardly into the neck section 40. The pole well 46 insertably receives the first end 32 of the pole 30 so the pole 30 is retained in and extends upwardly from the pedestal 38. The pedestal 38 may be an umbrella pedestal of any conventional design. A fastener 48 extends laterally through the top end 44 of the neck section 40 into the pole well 46. The fastener 48 frictionally engages the pole 30 so the pole 30 is retained in the pole well 46.

A collar 50 is provided that has a hollow, semi-hemispherical shape. A top 52 of the collar 50 has a pole opening 54 to insertably receive the first end 32 of the pole 30 so the collar 50 is positioned around the pole 30. An inside edge 56 of the pole opening 54 abuts an outer surface 58 of the pole 30 so the collar 50 forms a fluid impermeable seal around the pole 30. The collar 50 may be comprised of a fluid impermeable and resiliently deformable material such as rubber or other similar material. The collar 50 is one of a first collar 60 and a second collar 62.

The first collar 60 is positioned on the pole 30 such that a bottom edge 64 of the first collar 60 abuts the upper surface 22 of the table 12 when the first end 32 of the pole 30 is positioned in the pedestal 38. A bottom 66 of the first collar 60 has a diameter that is greater than a diameter of the pole aperture 14 so the first collar 60 completely covers the pole aperture 14. The bottom 66 of the first collar 60 may have a diameter between 9.5 cm and 12 cm. The first collar 60 prevents precipitation 68 from passing through the pole aperture 14 in the table 12 and traveling downwardly along the pole 30. The first collar 60 prevents corrosion of the pedestal 38 due to accumulation of precipitation 68 in the pole well 46.

The second collar 62 is positioned on the pole 30 such that the second collar 62 is positioned above the neck section 40 of the pedestal 38 when the first end 32 of the pole 30 is inserted into the pole well 46. A bottom 70 of the second collar 62 may have a diameter between 9.5 cm and 12 cm. The second collar 62 prevents precipitation 68 from entering the pole well 46.

The second collar 62 prevents corrosion of the pedestal 38 due to accumulation of precipitation 68 is the pole well 46.

A sleeve 72 has a first end 74 and a second end 76. The first end 74 of the sleeve 72 insertably receives the second end 34 of the pole 30. The sleeve 72 is downwardly slidable on the pole 30 when the umbrella shaft 16 is not positioned within the pole 30 so the sleeve 72 covers the pole 30. The sleeve 72 may be comprised of polyvinyl chloride or other similar material. The sleeve 72 may have a length between 0.3 meters and 0.6 meters.

A coupler 78 has a first end 80 and a second end 82. The first end 80 of the coupler 78 has a diameter that is greater than a diameter of the second end 82 of the coupler 78. The second end 82 of the coupler 78 insertably receives the first end 74 of the sleeve 72 so the coupler 78 is coupled to the sleeve 72 proximal the first end 74 of the sleeve 72. The first end 74 of the coupler 78 abuts a top 84 of the first collar 60 when the sleeve 72 is positioned on the pole 30. The coupler 78 may be comprised of polyvinyl chloride or other similar material.

A cap 86 is positionable on the second end of 82 the sleeve 72 after the sleeve 72 is positioned over the pole 30 so the cap 86 closes the second end 82 of the sleeve 72. The cap 86 prevents precipitation from entering the pole 30. The cap 86 prevents corrosion of the pedestal 38 due to accumulation of precipitation 68 in the pole well 46. The cap 86 may be comprised of polyvinyl chloride or other similar material.

In use, the first collar 60 may be positioned on the pole 30 before the pole 30 is inserted into the pole aperture 14 on the table 12. The second collar 62 may be positioned on the pole 30 after the pole is inserted into the pole aperture 14 on the table 12. The sleeve 72, coupler 78 and cap 86 may be used to protect the pedestal 38 from precipitation 68 when the umbrella 18 is not being used. If the umbrella shaft 16 is long enough to be inserted into the pole well 46 in the pedestal 38 while keeping the umbrella canopy 20 sufficiently elevated above the table 12, the pole 30 may not be utilized. In this instance the first 60 and second 62 collars may be positioned on the umbrella shaft 16 instead of being positioned on the pole 30.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

I claim:

1. A table umbrella precipitation guard assembly comprising:

a table having a pole aperture extending therethrough whereby said pole aperture is configured for receiving a shaft of an umbrella therethrough such that a canopy of the umbrella is positioned above said table;

a pole having a first end and a second end, said pole having a well extending inwardly from said second end, said first end of said pole being directed downwardly through said pole aperture on said table whereby said second end is positioned above said table, said well insertably receiving an end of the umbrella shaft whereby the umbrella canopy is positioned above said table;

a pedestal positioned beneath said table, said pedestal insertably receiving said first end of said pole;

a collar positioned around said pole such that said collar abuts said table when said pole is extended through said pole aperture whereby said collar prevents precipitation from passing through said pole aperture;

a sleeve being positionable on said pole when the umbrella shaft is not positioned within said pole;

a coupler coupled to an end of said sleeve whereby said coupler abuts said collar when said sleeve is positioned on said pole; and a cap positioned on an end of said sleeve whereby said cap closes said sleeve.

2. The assembly according to claim 1, further including said table having an upper surface, a lower surface and an exterior edge, said pole aperture being positioned at a center of said table whereby said pole aperture extends through said table between said upper and lower surfaces of said table.

3. The assembly according to claim 1, further including said pedestal having a neck section coupled to and extending upwardly from a base section of said pedestal, a top end of said neck section having a pole well extending downwardly into said neck section, said pole well insertably receiving said first end of said pole whereby said pole is retained in and extends upwardly from said pedestal.

4. The assembly according to claim 1, further including said collar having a hollow, semi-hemispherical shape, a top of said collar having a pole opening to insertably receive said first end of said pole whereby said collar is positioned around said pole, an inside edge of said pole opening abutting an outer surface of said pole whereby said collar forms a fluid impermeable seal around said pole.

5. The assembly according to claim 1, further including said collar being one of a first collar and a second collar.

6. The assembly according to claim 5, further including said first collar being positioned on said pole such that a bottom edge of said first collar abuts an upper surface of said table when said first end of said pole is positioned in said pedestal, a bottom of said first collar having a diameter being greater than a diameter of said pole aperture whereby said first collar completely covers said pole aperture.

7. The assembly according to claim 5, further comprising:

said pedestal including a neck section, a top end of said neck section having a pole well extending downwardly into said neck section;

said first collar preventing precipitation from passing through said pole aperture in said table and traveling downwardly along said pole whereby said first collar prevents corrosion of said pedestal due to accumulation of precipitation in said pole well.

8. The assembly according to claim 5, further including:

said pedestal including a neck section, a top end of said neck section having a pole well extending downwardly into said neck section;

said second collar being positioned on said pole such that said second collar is positioned above said neck section of said pedestal when said first end of said pole is inserted into said pole well, said second collar preventing precipitation from entering said pole well whereby said second collar prevents corrosion of said pedestal due to accumulation of precipitation is said pole well.

9. The assembly according to claim 1, further including said sleeve having a first end and a second end, said first end of said sleeve insertably receiving said second end of said pole, said sleeve being downwardly slidable on said pole whereby said sleeve covers said pole.

10. The assembly according to claim 9, further including said coupler having a first end and a second end, said first end of said coupler having a diameter being greater than a diameter of said second end of said coupler, said second end of said coupler insertably receiving said first end of said sleeve whereby said coupler is coupled to said sleeve proximal said first end of said sleeve.

11. The assembly according to claim 10, further including:

said collar being one of a first collar and a second collar;

said first end of said coupler abutting a top of said first collar when said sleeve is positioned on said pole.

12. The assembly according to claim 9, further including said cap being positionable on said second end of said sleeve after said sleeve is positioned over said pole whereby said cap closes said second end of said sleeve, said cap preventing precipitation from entering said pole whereby said cap prevents corrosion of said pedestal due to accumulation of precipitation in said pole well.

13. A table umbrella precipitation guard assembly comprising:

a table having a pole aperture extending therethrough, said pole aperture being configured for receiving a shaft of an umbrella therethrough such that a canopy of the umbrella is positioned above said table, said table having an upper surface, a lower surface and an exterior edge, said pole aperture being positioned at a center of said table whereby said pole aperture extends through said table between said upper and lower surfaces of said table;

a pole having a first end and a second end, said pole having a well extending inwardly from said second end, said first end of said pole being directed downwardly through said pole aperture on said table whereby said second end is positioned above said table, said well insertably receiving an end of the umbrella shaft whereby the umbrella canopy is positioned above said table;

a pedestal positioned beneath said table, said pedestal having a neck section coupled to and extending upwardly from a base section of said pedestal, a top end of said neck section having a pole well extending downwardly into said neck section, said pole well insertably receiving said first end of said pole whereby said pole is retained in and extends upwardly from said pedestal;

a collar having a hollow, semi-hemispherical shape, a top of said collar having a pole opening to insertably receive said first end of said pole whereby said collar is positioned around said pole, an inside edge of said pole opening abutting an outer surface of said pole whereby said collar forms a fluid impermeable seal around said pole, said collar being one of a first collar and a second collar, said first collar being positioned on said pole such that a bottom edge of said first collar abuts said upper surface of said table when said first end of said pole is positioned in said pedestal, a bottom of said first collar having a diameter being greater than a diameter of said pole aperture whereby said first collar completely covers said pole aperture, said first collar preventing precipitation from passing through said pole aperture in said table and traveling downwardly along said pole whereby said first collar prevents corrosion of said pedestal due to accumulation of precipitation in said pole well, said second collar being positioned on said pole such that said second collar is positioned above said neck section of said pedestal when said first end of said pole is inserted into said pole well, said second collar preventing precipitation from entering said pole well whereby said second collar prevents corrosion of said pedestal due to accumulation of precipitation is said pole well;

a sleeve having a first end and a second end, said first end of said sleeve insertably receiving said second end of said pole, said sleeve being downwardly slidable on said pole when the umbrella shaft is not positioned within said pole whereby said sleeve covers said pole;

a coupler having a first end and a second end, said first end of said coupler having a diameter being greater than a diameter of said second end of said coupler, said second end of said coupler insertably receiving said first end of said sleeve whereby said coupler is coupled to said sleeve proximal said first end of said sleeve, said first end of said coupler abutting a top of said first collar when said sleeve is positioned on said pole; and a cap being positionable on said second end of said sleeve after said sleeve is positioned over said pole whereby said cap closes said second end of said sleeve, said cap preventing precipitation from entering said pole whereby said cap prevents corrosion of said pedestal due to accumulation of precipitation in said pole well.

* * * * *